US005619173A

United States Patent [19]

King et al.

[11] Patent Number: 5,619,173

[45] Date of Patent: Apr. 8, 1997

[54] DUAL POLARIZATION WAVEGUIDE INCLUDING MEANS FOR REFLECTING AND ROTATING DUAL POLARIZED SIGNALS

[75] Inventors: Gerard King; Andrew P. Baird, both of Troon; Stephen J. Flynn, Dunure, all of Scotland

[73] Assignee: Cambridge Computer Limited, United Kingdom

[21] Appl. No.: 167,893

[22] PCT Filed: Jun. 15, 1992

[86] PCT No.: PCT/GB92/01065

§ 371 Date: May 2, 1994

§ 102(e) Date: May 2, 1994

[87] PCT Pub. No.: WO92/22938

PCT Pub. Date: Dec. 23, 1992

[30] Foreign Application Priority Data

Jun. 18, 1991 [GB] United Kingdom ..... 9113090

[51] Int. Cl.[6] ..... H01P 1/161; H01P 1/165

[52] U.S. Cl. ..... 333/125; 343/756; 333/21 A; 333/137

[58] Field of Search ..... 333/135, 137, 333/125, 21 A; 343/756

[56] References Cited

U.S. PATENT DOCUMENTS 4,596,047 6/1986 Watanabe et al. ..... 333/21 A X
5,374,938 12/1994 Hatazawa et al. ..... 333/125

FOREIGN PATENT DOCUMENTS 67301 4/1982 Japan ..... 333/21 A
176303 9/1985 Japan ..... 333/125
52001 3/1986 Japan ..... 333/21 A
4134901 5/1992 Japan ..... 333/21 A

*Primary Examiner*—Benny T. Lee
*Attorney, Agent, or Firm*—Gifford, Krass, Groh, Sprinkle, Patmore, Anderson & Citkowski, P.C.

[57] ABSTRACT

A dual polarisation waveguide probe system for use with a satellite dish (10) for receiving satellite signals orthogonally polarised in the same frequency band and for providing improved isolation between these polarised satellite signals is disclosed. The probe system has a waveguide (28) incorporated in a low-noise block receiver (12) into which two probes (34, 38) are located for receiving linearly polarised energy of both orthogonal senses. The probes (34, 38) are located in the same longitudinal plane on opposite sides of a single cylindrical bar reflector (36) which reflects one sense of polarisation and passes the orthogonal signal with minimal insertion loss, and then reflects the rotated orthogonal signal. The probes (34, 38) are spaced λ/4 from the reflector (36). A reflection rotator (44) is also formed using a thin plate which is orientated at 45° to the incident linear polarisation with a short circuit (46) spaced approximately a quarter wavelength (λ/4) behind the leading edge of the plate (43). This structure splits the incident energy into two equal components in orthogonal planes, one component being reflected by the leading edge (43) and the other component being reflected by the waveguide short circuit (46). The resultant 180° phase shift between the reflected components causes a 90° rotation in the plane of linear polarisation upon re-combination so that the waveguide outputs (34*a*, 38*a*) are located in the same longitudinal plane. Various embodiments and advantages of the invention are described.

12 Claims, 3 Drawing Sheets

62
VAR
VBR
60
VOUT

64
L
62
VA
VB
60
VIN
45°

70
68
Va
Vb
S
66
68
45°
VIN
VOUT 42
34
36
24
50

DUAL POLARIZATION WAVEGUIDE INCLUDING MEANS FOR REFLECTING AND ROTATING DUAL POLARIZED SIGNALS

The present invention relates to a dual polarisation waveguide probe system for use with a satellite dish for receiving signals broadcast by a standard satellite which includes two signals orthogonally polarised in the same frequency band. In particular, the invention relates to a waveguide for use with a low-noise block receiver into which two probes are disposed for coupling from the waveguide desired broadcast signals to external circuitry.

DESCRIPTION OF THE RELEVANT PRIOR ART

In one prior art arrangement the two probes are axially separated along the length of the waveguide. Because the desired signals are orthogonally polarised to each other, the two probes are also located in the waveguide at 90° to each other. In this arrangement a reflective post is located between the two probes, but parallel to the first probe and spaced therefrom by a quarter wavelength distance assuming a maximum field and optimum coupling to the probe. With this structure the geometry is such that the probe output terminals on the outside of the waveguide are at 90° to each other. This provides a mechanical problem in connecting the probe outputs directly to a planer printed circuit board. A further problem is that inadequate connection between probe and printed circuit board could cause increased losses at the frequencies involved which are about 10–11 GHz.

In a second prior art arrangement the two probes are located at the same axial position along the waveguide, but are at 90° to each other by virtue of being printed on the circuit board and are separated by a isolation patch, also printed on the circuit board, to provide the necessary isolation between the collected signals. With this arrangement the circuit board effectively splits the waveguide into two parts and this results in increased mechanical complexity. In addition, this arrangement of the two probes at the same axial location does not provide as good an isolation between the orthogonal signals as does the axially separated probe arrangement.

In another prior art arrangement the two probes are located at 90° at the same axial location in a single waveguide section. With this structure the output terminals of the probes are also at 90° to each other around the outside of the waveguide and suffers from the same disadvantages as the first prior art arrangement. It also suffers from some of the disadvantages of the second prior arrangement, namely that the provision of the two probes at the same axial location does not provide as good an isolation between the orthogonal signals as does the axially separated probe arrangement.

An object of the present invention is to obviate or mitigate at least one of the aforementioned disadvantages.

This is achieved by providing a waveguide which allows two co-axial or printed probes disposed in the same plane to be used in such a manner that one probe receives linearly polarised energy of one sense and the other probe receives linearly polarised energy of the orthogonal sense.

The waveguide may be circular or non-circular cross-section, for example, square. It also may be of uniform cross-section along its length or the cross-section may vary slightly. In a preferred embodiment the cross-sectional is symmetrical, i.e. circular or square.

In one embodiment a single cylindrical bar is used as the reflector means which reflects one sense of polarisation and passes the orthogonal signal with minimal insertion loss, and then reflects the rotated orthogonal signal. In an alternative embodiment a separate reflector means may be used for each probe, both reflector means being parallel and spaced apart in the same longitudinal plane and being separated from their respective probes by $\lambda/4$ (a quarter of the wavelength of interest).

A reflection rotator is also formed using a similar cylindrical bar which is orientated at 45° to the incident linear polarisation with a short circuit spaced approximately a quarter wavelength ($\lambda/4$) behind it. This structure splits the incident energy into two equal components in orthogonal planes, one component being reflected by the bar and the other component being reflected by a waveguide short circuit. The resultant 180° phase shift between the reflected components causes a 90° rotation in the plane of linear polarisation upon re-combination.

In an alternative arrangement a metal grid, which may be either free-standing or printed on to a substrate may be used as a short circuit as the basis of the reflector rotator. Alternatively, in a further arrangement the reflector rotator is provided by a differential phase shift section such as a modified waveguide cross section or a shaped dielectric slab.

According to one aspect of the present invention there is provided an apparatus for receiving at least tow signals which are orthogonally polarised, the apparatus comprising a waveguide into which the at least two orthogonally polarised signals are received for transmission therealong, the waveguide having;

a first probe extending from a wall of the waveguide into the interior of the waveguide, the first probe being adapted to receive the orthogonal signal travelling in the same longitudinal plane thereof, reflector means extending form the wall of the waveguide, the reflector means located downstream of the first probe and lying in the longitudinal plane for reflecting signals in the first orthogonal plane back to the first probe means and allowing the signal in the second orthogonal plane to pass along the waveguide, second probe means located downstream of the first reflector means and extending from the wall of said housing into the interior of the waveguide and lying in the longitudinal plane, reflecting and rotating means located downstream of the second probe means for receiving, rotating and reflecting the second orthogonally polarised signal back along the waveguide such that the rotated and reflected signal is received by the second probe means, the first and second probes having respective first and second outputs located on the outside of the waveguide, the first and second outputs lying in substantially the same longitudinal plane.

The reflector means can be a single post separated from each probe by $\lambda/4$ (a quarter of the wavelength of interest) or two spaced posts separated from the respective probes by $\lambda/4$.

The reflector means may be a cylindrical post extending across the interior of the waveguide. However, in a preferred arrangement the cylindrical post length is slightly less than the interior diameter of the waveguide.

The reflecting and rotating means is disposed at 45° to the longitudinal plane in which the probes and the reflector means lie. The reflecting and rotating means may be provided by a cylindrical rod and a short circuit. Alternatively, in a preferred arrangement the reflecting and rotating means is provided by a thin plate and short circuit disposed in said waveguide at 45° to said longitudinal plane.

Consequently the outputs of the first and second probe lie in the same longitudinal axis. Also the first and second probes and the reflecting means may be adjustable relative to the waveguide so that the waveguide can be tuned to maximise cross-polarisation isolation.

The waveguide is preferably of symmetrical cross-section, for example, circular or square. The waveguide my also be of uniform cross-section along its length or the cross-section could vary slightly.

According to another aspect of the present invention there is provided a low-noise block receiver for use with a satellite receiving dish, the low noise block receiver comprising a waveguide having first and second probe outputs on the same longitudinal axis on the outside of the waveguide, circuit means located on the outside of said waveguide, the circuit means being coupled to said first and second probe outputs, housing means surrounding the circuit means and extending beyond the rear of the waveguide, the circuit means having an output through the housing means, the output being transverse to the longitudinal axis of the waveguide and spaced from the end of the waveguide so that the output is shielded by the housing and the end of the waveguide.

Conveniently the circuit output my also be covered by a shroud.

According to another aspect of the present invention there is provided a method of receiving at least two orthogonally polarised signals in a waveguide and providing at least two outputs in a common longitudinal plane, the method comprising the steps of providing a first probe in the waveguide to receive a first orthogonally polarised signal, providing a reflector means in the waveguide parallel to and downstream from the first probe for reflecting the first orthogonally polarised signal and for allowing passage of the second orthogonally polarised signal, providing a second probe in the waveguide parallel to and downstream of the reflector means, the second probe being substantially orthogonal to the second polarised signal which passes the second probe without being received by the second probe, providing a rotating and reflector means at the end of the waveguide downstream of the second probe for receiving the second orthogonally polarised signal and for reflecting the second signal back along the waveguide towards the second probe, the rotating and reflecting means being oriented at an angle of 45° to the common longitudinal plane, the signal also being rotated to lie in the same longitudinal plane as the second probe and to be received by the second probe, and taking outputs from the first and second probes on the outside of waveguide, the outputs being disposed in the same longitudinal plane.

According to yet a further aspect of the present invention there is provided a method of manufacturing a waveguide the method comprising the steps of providing a waveguide of uniform cross-sectional area, providing a plurality of apertures in the surface of the waveguide on a common longitudinal axis, for receiving at least two probes and a reflector means, inserting two probes and a reflector means into the respective aperture, providing a reflecting and rotating means in the end of the waveguide in the form of a thin plate which protrudes from the end of the waveguide into the waveguide.

In a preferred method, this is conveniently achieved by casting the waveguide with the thin plate.

In another aspect of the invention there is provided a waveguide for receiving two orthogonally polarised signals, the waveguide having, a first probe means extending from the wall of the waveguide into the interior of the waveguide for receiving a first orthogonal signal travelling in the same longitudinal plane thereof;

a single reflector means extending from the wall of the waveguide and located downstream of the first probe and lying in the longitudinal plane;

a second probe means located downstream of the single reflector means extending from the wall of the waveguide into the interior of the waveguide and lying in the longitudinal plane for receiving the second orthogonal signal which has been rotated by 90° into the longitudinal plane;

the single reflector means being spaced from the first and second probes by $\lambda/4$ where $\lambda$ is the wavelength of the signals in the waveguide.

Preferably, the single reflector means is a cylindrical post.

BRIEF DESCRIPTION OF THE DRAWINGS

These and other aspects of the invention will become apparent from the following description when taken in combination with the accompanying drawings in which.

DETAILED DESCRIPTION OF THE PREFERRED EMBODIMENTS

Figure 1:
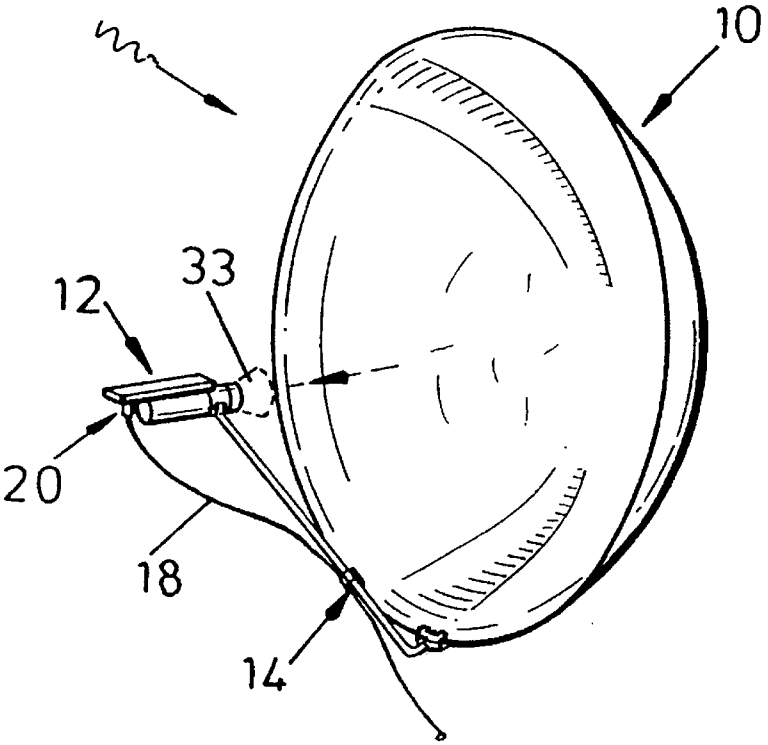
FIG. 1 is diagrammatic representation of a satellite receiving dish with a low-noise block receiver in accordance with an embodiment of the present invention shown mounted on the dish for receiving signals from the dish.

Reference is first made to FIG. 1 of the drawings which depicts a parabolic satellite receiving dish generally indicated by reference numeral 10 having a low-noise block receiver, generally indicated by reference numeral 12, mounted thereto by means of the support state 14. The low-noise block receiver 12 is arranged to receive high frequency radiation signals from the satellite dish and to process these signals, as will be later described in detail, to provide an output from the low-noise block receiver which is fed to a cable 18 from an output 20 of the low-noise block receiver 12.

Figure 2:
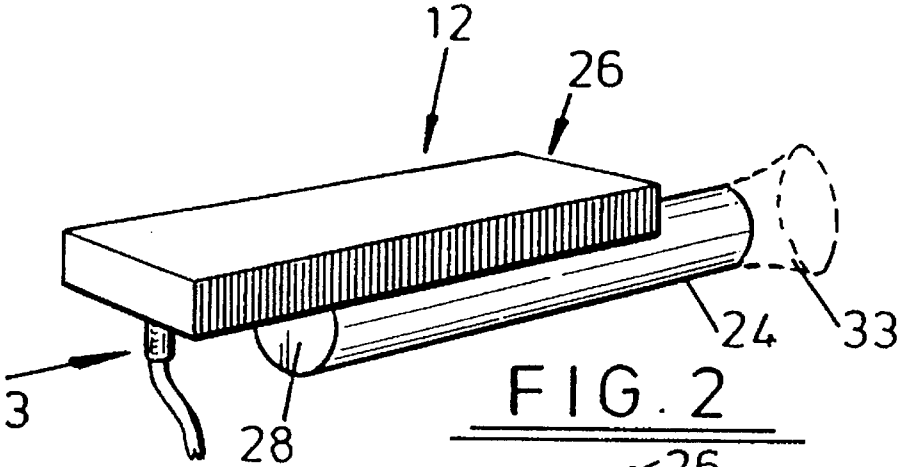
FIG. 2 is an enlarged perspective view of the block receiver shown in FIG. 1.
Figure 3:
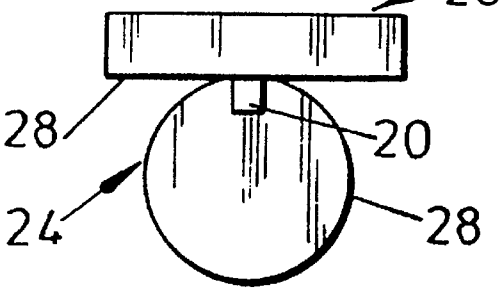
FIG. 3 is an end view of the block receiver taken in the direction of arrow 3 of FIG. 2.

Reference is now made to FIGS. 2 and 3 of the drawings which depict the low-noise block receiver 12 in more detail. The block receiver 12 consists of two principal parts, a generally cylindrical waveguide 24 and a rectangular box-like housing 26 (also shown in FIGS. 4 and 5) which is mounted on top of the waveguide as shown. The housing 26 overlaps the end 28 of the waveguide 24 and the underside of the housing 26 carries the output terminal 20 (see FIG. 3) which is disposed just behind the end 28 of the waveguide. As will be appreciated the output from waveguide 28 is sheltered by the rear of the waveguide and the housing to minimise the ingress of water. In this position the output can be easily shrouded to provide further security.

Figures 4, 5, 6:
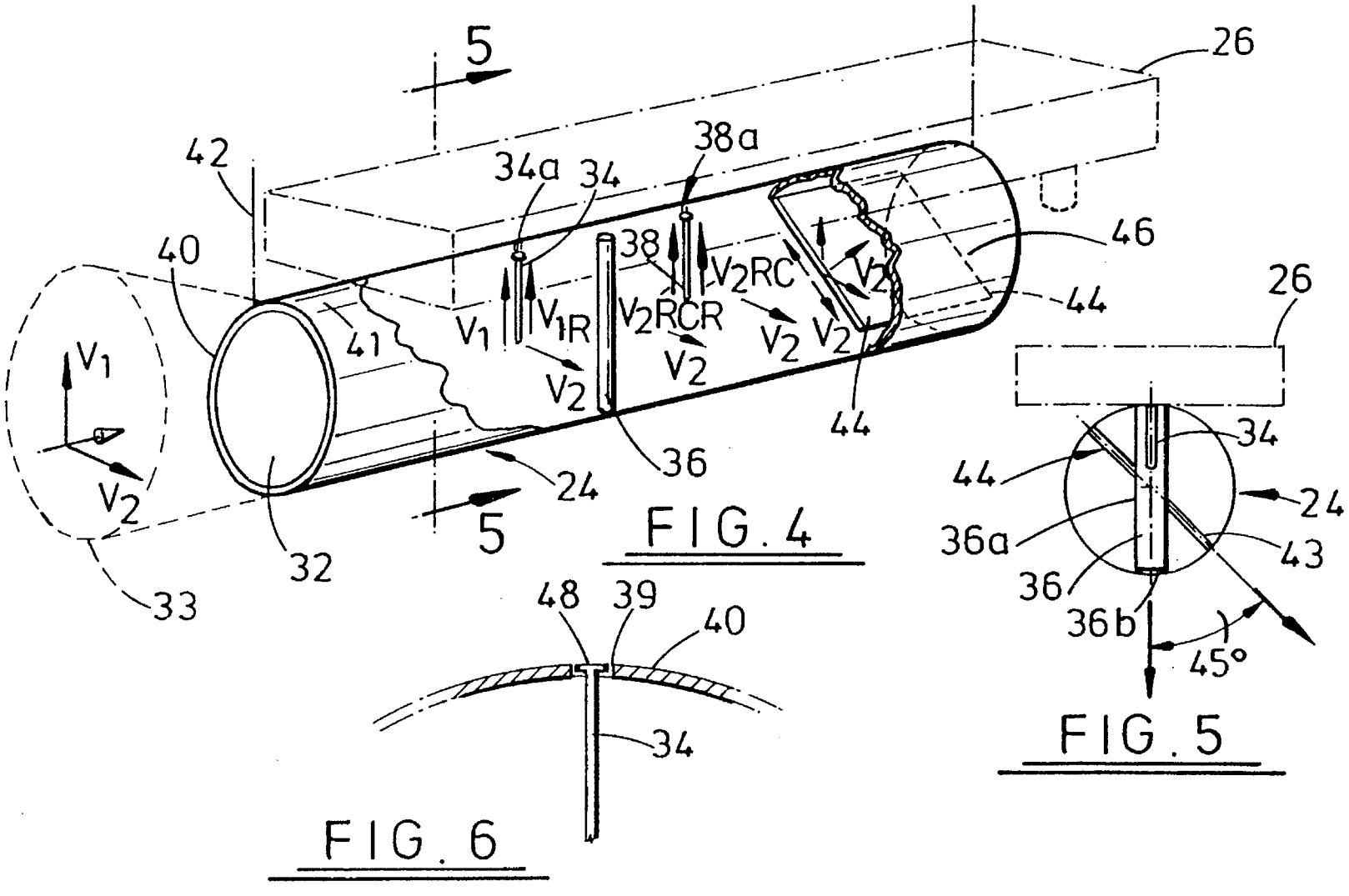
FIG. 4 is an enlarged and partly broken away view of the block receiver shown in FIGS. 1–3 with the waveguide shown in detail.
FIG. 5 is a cross-sectional view of the waveguide taken on section 5—≡of FIG. 4.
FIG. 6 depicts part of a cross-sectional view through the waveguide at the location of a probe.

Reference is now made to FIG. 4 of the drawings which depicts an enlarged view of the waveguide 24 and which is partly broken away to depict the interior components of the waveguide. As can be seen the waveguide is cylindrical and is made of metal. The waveguide has a front aperture 32 which faces the satellite dish 10 (see FIG. 1) for receiving electro-magnetic radiation from feed horn 33 (also shown in FIGS. 1 and 2) mounted on front of the waveguide shown in a broken outline. Disposed within the waveguide in the same longitudinal plane are a first probe 34, a reflective post 36 and a second probe 38. The outputs of the probes 34 and 38 pass through the waveguide wall 40 and lie in the same longitudinal plane generally indicated by reference numeral 42. The probes are designed to be of the same length so that the outputs lie along the same longitudinal axis 41 within the longitudinal plane 42. The distance between the probe 34 and reflective post 36 and the distance between probe 38 and reflective post 36 is ¼λ where λ is the wavelength of the signals in the waveguide. At the downstream end of the waveguide, that is the end furthest from front aperture 32, there is disposed within the waveguide a reflecting and rotating plate 44. As best seen in FIG. 5 the reflecting and rotating plate 44 is downstream of probe 38 (see FIG. 4) and is oriented at an angle of 45° to the probe 38 and reflective post 36. The end of the plate 44 terminates in a wall 46 (FIG. 4) which acts as a short circuit as will be later explained in detail. Probes 34 and 38 are mounted on insulating buses 39 on the waveguide wall 40 as shown in FIG. 6 where the probes have a shoulder region 48 which fits into a mating recess in bush 39 to securely fasten the probe in the waveguide.

The reflective post 36 does not extend the entire diameter of the interior of the waveguide 24. The post 36 consists of a reflecting portion **36*a* (see FIG. 5) which is made of metal and performs a reflecting function and there is a small space between the bottom of the post and the interior of the waveguide which contains a non-reflecting portion 36*b*, as shown in FIG. 5**. This design of post has resulted in a substantial increase in isolation between the signals of the order of 40 dB. across the useable bandwidth.

In operation, the electro-magnetic signals from the dish 10 are transmitted across air and enter the waveguide 24 via aperture 32 and in accordance with known principles are transmitted along waveguide 24. The signals broadcast by the satellite include two signals which are orthogonally polarised in the same frequency band. These signals are represented by vectors $V_1$ and $V_2$ which are signals polarised in the vertical and horizontal planes respectively, as shown in FIG. 4. As the signals travel along the waveguide 24, the vertically polarised signal $V_1$ is received by first probe 34 which, as it is spaced by λ/4 from the reflecting post 36, ensuring a maximum field at the probe and hence optimum coupling to the probe. The probe 34 has no effect on the horizontally polarised signal $V_2$ and this continues to pass along the waveguide.

As the reflecting post 36 is vertically oriented the horizontally polarised signal $V_2$ is not reflected by the post and continues to pass along the waveguide 24. Similarly, $V_2$ passes the second probe 38 which is located in the same longitudinal vertical plane as probe 34 and reflecting probe 36. As the horizontally polarised signal $V_2$ passes along the waveguide it encounters the edge 43 (see FIG. 5) of thin metal plate 44 (1–1.5 mm) which is oriented at 45° to the longitudinal plane containing probes 34, 38 and reflecting post 36. The thin plate 44 acts as a reflector and rotator device which, as will be described, provides a twist to the plane of the radiation in the waveguide and the reflector is terminated by a waveguide short circuit 46. When the horizontally polarised signal encounters the edge 43, it is split into two equal magnitude components in orthogonal planes, one component being reflected by the edge 43 and the other reflected by the short circuit 46 at the rear of the plate. Because the short circuit 46 is spaced λ/4 from the edge 43, the resulting 180° phase shift between the reflected components results in a 90° rotation in the plane of linear polarisation upon their combination. The reflected and combined signal indicated by vector $V_{2RC}$ (see FIG. 4) then travels towards probe 38 in the longitudinal plane 42 where it is received by the same probe 38 and conducted to the probe output **38*a*. Probe 38 is spaced from post 36 by ¼ λ ensuring a maximum field at probe 38** and hence optimum coupling.

This arrangement provides a very high degree of isolation between the signals collected by probes 34, 38 respectively. With this arrangement, isolation of 40 dB. across the full bandwidth has been obtained which is higher than some of the prior art arrangements and mechanically better than others. This is due not only to the afore-described orientation of the probes and reflection and rotation arrangement, but also to the fact that the length of the reflector post 36 has been shortened so that it no longer spans the entire diameter of the waveguide. This is significant because the performance is better than 40 dB. across the full Astra satellite band width (10.95–11.7 GHz.) and across other bandwidths such as 11.7–12.2 GHz. for DBS; and 12.2–12.75 GHz. for some other applications. It also satisfies the isolation requirements predicted for the United States which are greater than 27 dB. isolation over the band width of 11.7–12.2 GHz. In summary, the waveguide arrangement provides good isolation of at least 30 dBs. over a bandwidth of approximately 10%.

With the afore-described embodiment it will be seen that the outputs of probes **34*a* and 38*a* lie in the same longitudinal line 41, as shown in FIG. 4. This means that the printed circuitry (not shown) located within housing 26 is able to be connected to the outputs so as to minimise mechanical complexity, as seen in FIG. 3**, thus minimising radiation losses associated with manufacturing tolerances. Alternatively this allows the probes to be printed on the same microstrip substrate as the receiver. The length of the reflector post is less than the diameter of the orthogonal polarised waveguide and results in increased isolation between orthogonally polarised signals. The use of the thin plate means that the product can be cast which represents substantial advantage in manufacture.

Figures 7, 8A, 8B, 8C:
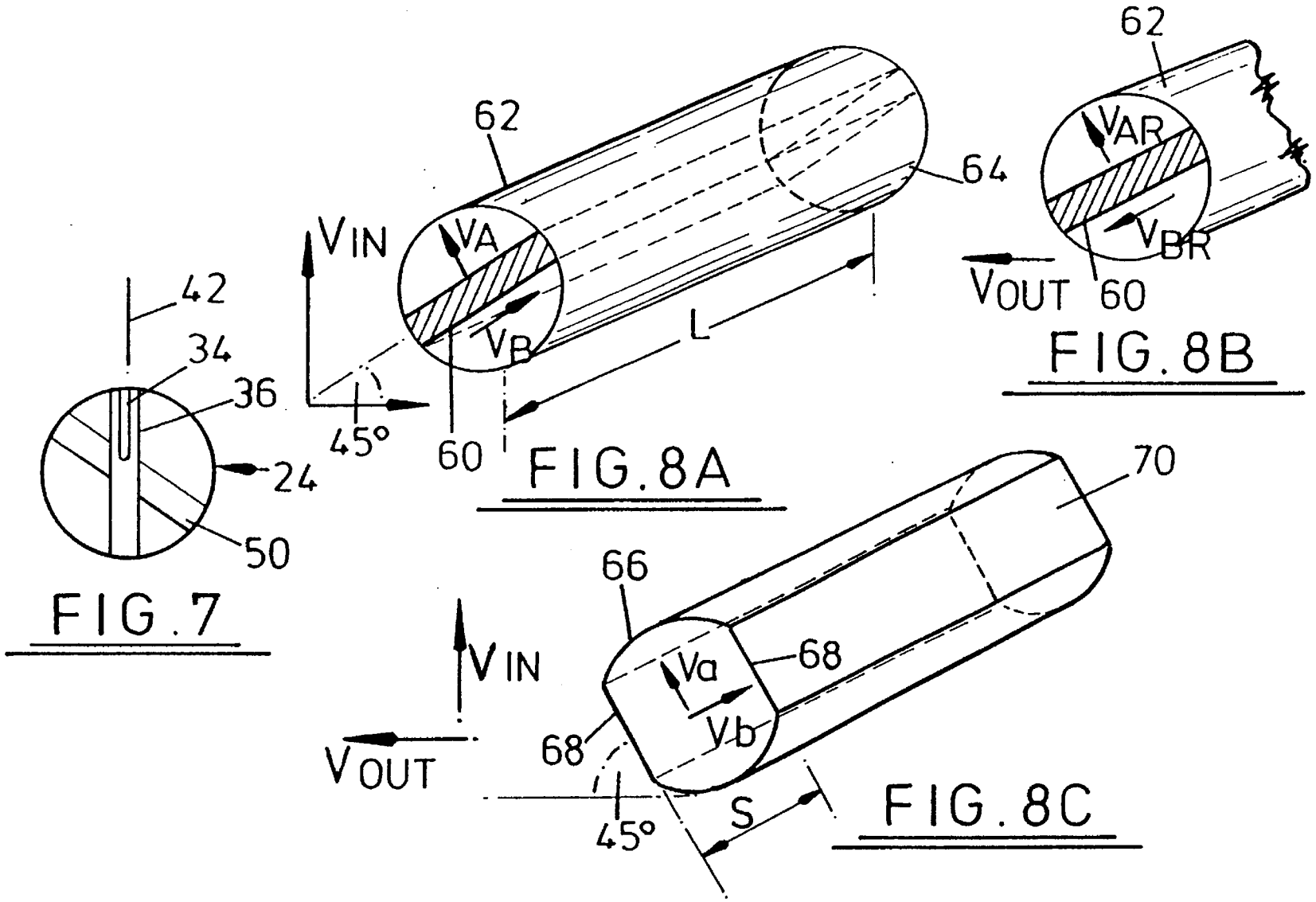
FIG. 7 is a view of the waveguide similar to that shown in FIG. 5 in which the rotating and reflective plate has been replaced by a second reflective post in accordance with a second embodiment of the invention.
FIGS. 8A, 8B and 8C show a further embodiment of a reflecting and rotating element for use with the waveguide shown in FIG. 4.

Various modifications may be made to the invention hereinbefore described without departing from the scope of the invention. It will be understood that the waveguide described in detail herein is circular in cross-section throughout its length. However, the waveguide may be square in cross-section. In addition, the waveguide may vary in cross-section along its length, although for reasons for maximum efficiency the waveguide should be symmetrical. If the waveguide varies in cross-section along its length, it will be understood that the probes 34 and 38 may be of different lengths so that they project into the waveguide by substantially the same amount. It will be understood that the first and second outputs of the probes ideally lie in the same longitudinal plane as described in the embodiments. This is to maximise performance. However, if the outputs do not lie in exactly the same plane, then the performance may still be acceptable but less than ideal. Such variation could be due to manufacturing tolerances and the like and such a structure is still within the scope of the invention. The probes may be located in the waveguide without the use of bushes. In addition, it will be understood that the horn 33 may be of any suitable size and may in fact be twice the diameter of the waveguide, four times the diameter of the waveguide or in certain applications it may even be about the same size as the waveguide. Although a single cylindrical post has been described as the reflector means (short circuit) for both probes 34 and 38, it will be appreciated that separate reflector means may be used for probes 34 and 38. The reflector means will lie in the same longitudinal plane and each reflector means will be spaced from its respective probe by a quarter wavelength. The reflector post can extend across the entire interior width/diameter of the waveguide. It will also be understood that the reflection rotator will work with different thicknesses of the metal plate 44. In addition, as seen in FIG. 7 the thin rotating and reflecting plate may be replaced by a reflector post 50 at 45° to the longitudinal plane 42 (along which probe 34 is located) and waveguide short circuit, not shown, which is separated by the post by a distance $\lambda/4$ and which acts to rotate and reflect $V_2$ as described above. Also a metal grid, either free standing or printed onto a substrate may be used instead of the reflector post 36 as the basis of the reflector and rotator plate 44.

It will also be understood that the reflecting and rotating means may be implemented by a different structure. This may be achieved by using a differential phase section as best seen in FIG. 8A, 8B and 8C. This is achieved by placing a dielectric slab 60 in the waveguide 62 (FIGS. 8A and 8B) where the dielectric slab 60 is oriented at 45° to the input Vector $V_2$ as seen in FIG. 8A. In this case, two equal components $V_a$, $V_b$ are formed from the input Vector $V_2$. The Vector $V_b$ has its electric field concentrated in the dielectric slab 60 so that it has a shorter guide wavelength than Vector $V_a$. The length, L, of the waveguide section is chosen such that a phase shift of $\pi/2$ occurs between the two Vector components $V_a$ and $V_b$. In this case, the same waveguide short circuit 64 is used for signals $V_a$ and $V_b$. After reflection from the common short circuit 64 a second phase shift of $\pi/2$ is introduced between the reflected signals $V_{aR}$ and $V_{bR}$ so that when the reflected signals re-combine there is a total phase sift of $\pi$ which has occurred between the components $V_{aR}$ and $V_{bR}$, as shown in FIG. 8*b*. This results in a rotation of 90° in the sense of linear polarisation $V_{out}$ when the signals re-combine as seen in FIG. 8B.

It will also be appreciated that the use of a differential phase shift section may be implemented by using the arrangements shown in FIG. 8C where a waveguide cross-section has been modified to a circle 66 with "flats" 68 which are oriented at 45° to the input Vector $V_{IN}$ and it is split into two substantially equal magnitude components $V_a$, $V_b$. In this case, a Vector $V_a$ experiences a different waveguide cross-section with a width S, and so it has a longer wavelength than Vector $V_b$ which behaves largely as though it were in a circular waveguide. Using a waveguide short circuit 70 as described above results in a re-combination of the signals when reflected so that the re-combined signal $V_{OUT}$ (see FIGS. 8B and 8C) rotates by 90° relative to $V_{IN}$ (see FIG. 8A) in the sense of linear polarisation.

The range of applications for the embodiments hereinbefore described include low-cost dual polarisation receiving systems such as the front end of a DBS receiver.

We claim:

1. Apparatus for receiving at least two signals including first and second signals which are orthogonally polarized with respect to each other, said apparatus comprising a waveguide including an interior having a width into which said at least two orthogonally polarized signals are received for transmission therealong, said orthogonally polarized signals propagating along a downstream direction in said waveguide, said waveguide having;

a first probe extending from a wall of the waveguide into the interior of the waveguide, a second probe located downstream of said first probe and extending from said wall of said housing into the interior of said waveguide, said first and second probes being oriented to define a longitudinal plane, said first probe being adapted to receive said first orthogonally polarized signal traveling in said longitudinal plane, reflector means including a cylindrical post extending from the wall of the waveguide, said post having a length slightly less than the interior width of the waveguide, said reflector means located between said first and second probes and lying in said longitudinal plane for reflecting said first signal in a first plane orthogonal to said longitudinal plane back to said first probe means and for allowing said second signal in a second plane orthogonal to said longitudinal plane to pass downstream along the waveguide, reflecting and rotating means located downstream of said second probe for receiving, rotating and reflecting said second orthogonally polarized signal back along said waveguide such that said rotated and reflected signal is received by said second probe, the first and second probes having respective first and second outputs located on an outside of the waveguide, the first and second outputs substantially lying in said longitudinal plane.

2. Apparatus as claimed in claim 1 wherein the reflector means is a single cylindrical post separated from each probe by a distance of $\lambda/4$, where $\lambda$ is the wavelength of the first and second signals.

3. Apparatus as claimed in claim 1 wherein the reflector means further comprises a second spaced cylindrical post, said cylindrical posts being separated from the respective probes by a distance of $\lambda/4$, where $\lambda$ is the wavelength of the first and second signals.

4. Apparatus as claimed in claim 1 wherein the waveguide is of uniform cross-section along a length thereof.

5. Apparatus as claimed in claim 1 wherein the waveguide has a variable cross-section along a length thereof.

6. Apparatus as claimed in claim 1 wherein the reflecting and rotating means is disposed at 45° to the longitudinal plane in which the probes and the reflector means lie.

7. Apparatus as claimed in claim 1 wherein the reflecting and rotating means is provided by a cylindrical rod and a short circuit operatively connected together.

8. Apparatus as claimed in claim 1 wherein the reflecting and rotating means is provided by a thin plate and short circuit operatively disposed in said waveguide at 45° to said longitudinal plane.

9. Apparatus as claimed in claim 1 wherein the first and second probes and the reflecting means are respectively adjustable relative to the waveguide so that the waveguide can be tuned to maximise cross-polarisation isolation.

10. Apparatus as claimed in claim 1 wherein the waveguide is of symmetrical cross-section.

11. A method of receiving at least two signals including first and second orthogonally polarized signals in a waveguide, said orthogonally polarized signals propagating along a downstream direction in said waveguide, and providing at least two outputs in a common longitudinal plane, said method comprising the steps of providing a first probe in said waveguide to receive first orthogonally polarized signal, disposing a reflector means including a cylindrical post, said post having a length slightly less than an interior width of the waveguide, in said waveguide parallel to and downstream from said first probe for reflecting said first orthogonally polarized signal and for allowing passage of said second orthogonally polarized signal, disposing a second probe in said waveguide parallel to and downstream of said reflector means and substantially orthogonal to said second polarized signal such that said second polarized signal passes downstream of the second probe without being received by said second probe, providing a rotating and reflector means at an end of the waveguide downstream of said second probe for receiving said second orthogonally polarized signal and for reflecting said second signal back along said waveguide towards said second probe, orienting said rotating and reflecting means at an angle of 45° to said common longitudinal plane, said signal also being rotated to lie in said common longitudinal plane as said second probe and to be received by said second probe, and disposing outputs from the first and second probes on an outside of the waveguide, and in substantially the same longitudinal plane thereto.

12. A waveguide for receiving first and second orthogonally polarized signals, said orthogonally polarized signals propagating along a downstream direction in said waveguide, said waveguide having, a first probe means extending from a wall of the waveguide into an interior of the waveguide;

a second probe means located downstream of said first probe means extending from the wall of the waveguide into the interior of the waveguide, said first and second probes being oriented to define a longitudinal plane, said first probe means for receiving the first orthogonally polarized signal traveling in the same longitudinal plane thereof and said second probe means for receiving the second orthogonal signal;

a single reflector means including a cylindrical post, said post having a length slightly less than the interior width of the waveguide, extending from the wall of the waveguide and located between the first and second probes and lying in said longitudinal plane for reflecting said first signal in a first plane orthogonal to said longitudinal plane back to said first probe means and allowing said second signal in a second plane orthogonal to said longitudinal plane to pass downstream along the waveguide;

said single reflector means being spaced from said first and second probes by a distance of $\lambda/4$, where $\lambda$ is the wavelength of the first and second signals.

* * * * *